United States Patent [19]

Noufer

[11] 4,453,121

[45] Jun. 5, 1984

[54] REFERENCE VOLTAGE GENERATOR

[75] Inventor: Glenn E. Noufer, Austin, Tex.

[73] Assignee: Motorola, Inc., Schaumburg, Ill.

[21] Appl. No.: 332,645

[22] Filed: Dec. 21, 1981

[51] Int. Cl.[3] ..... G05F 3/20

[52] U.S. Cl. ..... 323/226; 323/313

[58] Field of Search ..... 307/296 R, 297; 323/223, 225, 226, 304, 313, 314; 333/296, 297

[56] References Cited

U.S. PATENT DOCUMENTS

| | | | |
|---|---|---|---|
| 3,911,268 | 10/1975 | Mori et al. | 307/297 X |
| 3,975,648 | 8/1976 | Tobey et al. | 307/297 |
| 3,975,649 | 8/1976 | Kawagoe et al. | 307/297 X |
| 4,103,219 | 7/1978 | Wheatley | 323/313 X |
| 4,260,946 | 4/1981 | Wheatley | 323/314 |
| 4,287,438 | 9/1981 | Cave et al. | 307/297 |
| 4,362,984 | 12/1982 | Holland | 323/313 |

OTHER PUBLICATIONS

Tooker, "Accurate Low-Voltage Calibrator", Popular Electronics, vol. 29, No. 3, Sep. 1968, pp. 66.

*Primary Examiner*—A. D. Pellinen

*Attorney, Agent, or Firm*—Anthony J. Sarli, Jr.; Jeffrey Van Myers; James L. Clingan, Jr.

[57] ABSTRACT

A reference voltage generator uses a resistor divider technique to develop a reference voltage, but a resistor is replaced by a transistor to provide improved compensation for changes in a power supply voltage. The transistor is coupled to provide resistance which varies inversely to variations in power supply voltage.

1 Claim, 3 Drawing Figures

REFERENCE VOLTAGE GENERATOR

CROSS-REFERENCE TO A RELATED APPLICATION

Related subject matter is disclosed in the following related application filed simultaneously herewith and assigned to the assignee hereof:

1. U.S. patent application Ser. No. 332,646 entitled "TTL To CMOS Input Buffer."

TECHNICAL FIELD

The invention relates to reference voltage generators, and more particularly to MOS reference voltage generators having improved compensation for variations in power supply voltage.

BACKGROUND ART

A reference voltage generator can use a power supply voltage as a reference point for generating a reference voltage by a resistor divider technique when the percentage variation in power supply voltage is no greater than that required for the reference voltage. Advantages of this technique are that the circuit is simple and can be made to require very little power. A circuit, of the closest known prior art, uses this technique and is shown in FIG. 1. When the variation in power supply voltage is too great, then techniques for compensating for power supply voltage variation must be used. Conventional techniques include zener diode references and bandgap references. Both are power consuming bipolar techniques which, although potentially very accurate, may be undesirable for some uses, particularly where power consumption is a major consideration. In addition, zener diodes can be difficult to manufacture with adequate control in an MOS process.

BRIEF SUMMARY OF THE INVENTION

An object of the invention is to provide an improved reference voltage generator.

Another object of the invention is to provide a low power reference voltage generator which provides improved compensation for variations in power supply voltage.

Yet another object of the invention is to provide an MOS reference voltage generator which uses an insulated gate field effect transistor to provide improved compensation for variations in power supply voltage.

Yet another object of the invention is to provide an MOS reference voltage generator which has an insulated gate field effect transistor to provide improved compensation for variations in power supply voltage.

The above and other objects and advantages of the present invention are achieved by coupling a first transistor in place of a resistor in a resistor divider network. A resistor has a first terminal coupled to a first power supply terminal. A second terminal of the resistor is coupled to a first current electrode of the first transistor forming a first output node. The first transistor has a second current electrode coupled to a second power supply terminal, and a control electrode coupled to the first power supply terminal. The first transistor provides a resistance which is inversely proportional to a voltage difference between a voltage present on the first power supply terminal and a voltage present on the second power supply terminal.

A lower impedance reference voltage is provided by adding a second transistor. The second transistor has a control electrode coupled to the first output node, a first current electrode coupled to the first power supply terminal, and a second current electrode forming a second output node for providing a reference voltage.

A third transistor is interposed between the first transistor and the second power supply terminal. The third transistor has a control electrode and a first current electrode coupled to the second current electrode of the first transistor, and a second current electrode coupled to the second power supply terminal.

DESCRIPTION OF THE PREFERRED EMBODIMENT

Figure 1:
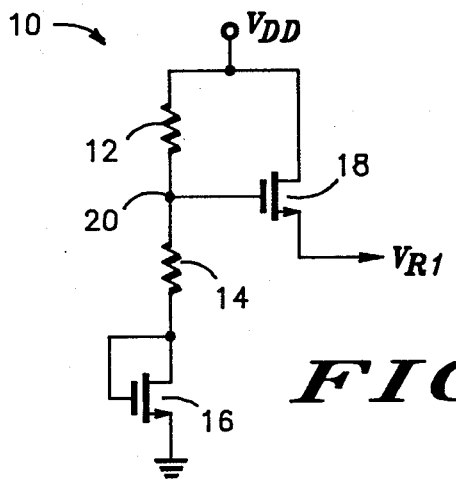
FIG. 1 ( PRIOR ART )
FIG. 1 is a circuit diagram of a reference voltage generator of the prior art.
Figure 2:
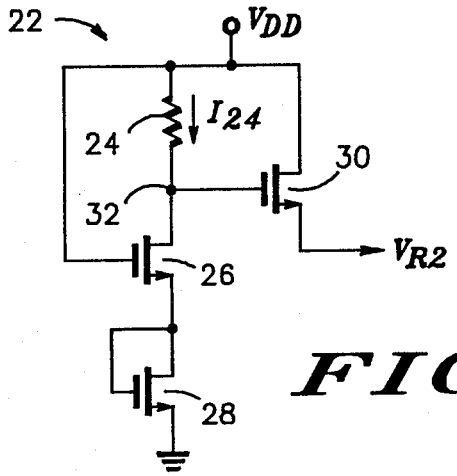
FIG. 2 is a circuit diagram of a reference voltage generator according to a preferred embodiment of the present invention.

Shown in FIG. 1 is a reference voltage generator 10 of the prior art comprised of a resistor 12, a resistor 14, a transistor 16 and a transistor 18. Both the prior art shown in FIG. 1 and a preferred embodiment shown in FIG. 2 are depicted using N channel insulated gate field effect transistors of an enhancement type having a characteristic threshold voltage of 0.4 to 0.8 volts. The circuit of FIG. 3 includes P channel insulated gate field effect transistors of an enhancement type having a characteristic threshold voltage of −0.4 to −0.8 volts.

Resistor 12 has a first terminal connected to a positive power supply terminal $V_{DD}$, and a second terminal connected to a node 20. Resistor 14 has a first terminal connected to node 20, and a second terminal. N channel transistor 16 has a gate and drain connected to the second terminal of resistor 14, and a source connected to a negative power supply terminal shown as ground. N channel transistor 18 has a control electrode coupled to node 20, a drain connected to $V_{DD}$, and a source providing an output of reference voltage generator 10. The output is a reference voltage $V_{R1}$.

Resistors 12 and 14 provide a standard resistor divider function. Transistor 16 is diode-connected to provide a threshold voltage drop in series with resistors 12 and 14. Transistor 16 has a size ratio (channel width to channel length) which is chosen by conventional means to provide essentially only the threshold voltage drop. Accordingly, a voltage $V_{20}$ at node 20 is expressed as a function of the voltage difference between the positive and negative power supply terminal voltages, in this case $V_{DD}$, a resistance $R_{12}$ of resistor 12, a resistance $R_{14}$ of resistor 14, and threshold voltage $V_{T16}$ of transistor 16 in the following equation:

$$V_{20} = \frac{R_{14}}{R_{12} + R_{14}} (V_{DD} - V_{T16}) + V_{T16} \quad (1)$$

Transistor 18 is connected as a source follower. The size ratio of transistor 18 is selected by conventional means so that reference voltage $V_{R1}$ is a threshold voltage $V_{T18}$ of transistor 18 below voltage $V_{20}$ as expressed in the following equation:

$$V_{R1} = V_{20} - V_{T18} \quad (2)$$

Although transistors 16 and 18 would have the same threshold voltage if the source of transistor 18 was connected to ground, because the source of transistor 18 is at a positive voltage, specifically reference voltage $V_{R1}$, threshold voltage $V_{T18}$ is increased beyond threshold voltage $V_{T16}$ by a body effect voltage $V_{B1}$ and can be expressed in the following equation:

$$V_{T18}=V_{T16}+V_{B1} \quad (3)$$

Substituting this expression for threshold voltage $V_{T18}$ into equation (2) results in the following equation:

$$V_{R1}=V_{20}-V_{T16}-V_{B1} \quad (4)$$

And now substituting the expression for voltage $V_{20}$ of equation (1) into equation (4):

$$V_{R1}=\frac{R_{14}}{R_{12}+R_{14}}(V_{DD}-V_{T16})+V_{T16}-V_{T16}-V_{B1} \quad (5)$$

Simplifying equation 5:

$$V_{R1}=\frac{R_{14}V_{DD}}{R_{12}+R_{14}}-\frac{R_{14}V_{T16}}{R_{12}+R_{14}}-V_{B1} \quad (6)$$

Equation (6) shows that reference voltage $V_{R1}$ can be selected by choosing resistances $R_{12}$ and $R_{14}$ for a given $V_{DD}$ and body effect voltage $V_{B1}$. Body effect voltage $V_{B1}$ is of a relatively small, repeatable magnitude which is a function of reference voltage $V_{R1}$. Diode-connected transistor 16 helps compensate for process variations in threshold voltage $V_{T18}$. Additional diode-connected transistors can be placed in series with resistors 12 and 14 as desired for the same purpose. A reference voltage output could be provided at node 20, however, transistor 18 is used to provide the output of voltage reference generator 10 in order to reduce output impedance. Large values for resistances $R_{12}$ and $R_{14}$ are chosen to minimize power consumption.

The reference voltage generator 10 provides, by a simple, power circuit, a relatively accurate, low output impedance reference voltage $V_{R1}$ so long as $V_{DD}$ is held constant. As shown in equation (6), the reference voltage $V_{R1}$, however, is proportional to $V_{DD}$.

Shown in FIG. 2 is a reference voltage generator 22 which retains advantages of reference voltage generator 10 but improves compensation for variations in power supply voltage. Reference voltage generator 22 comprises a resistor 24, an N channel transistor 26, an N channel transistor 28 and an N channel transistor 30. Resistor 24 has a first terminal connected to a positive power supply terminal $V_{DD}$, and a second terminal connected to a node 32. Transistor 26 has a drain connected to the second terminal of resistor 24, a gate connected to $V_{DD}$, and a source. Transistor 28 has a gate and drain connected to the source of transistor 26, and a source connected to a negative power supply terminal shown as ground. Transistor 30 has a drain connected to $V_{DD}$, a gate connected to node 32, and a source providing an output of reference voltage generator 10. The output is a reference voltage $V_{R2}$.

In effect, reference voltage generator 22 differs from reference voltage generator 10 of FIG. 1 by the replacement of resistor $R_{14}$ with transistor 26 in series with resistor 24 and transistor 28 and between node 32 and ground for the purpose of providing improved compensation for changes in $V_{DD}$. Transistor 26 will provide less resistance as $V_{DD}$ decreases. Transistor 26 provides resistance which is inversely proportional to $V_{DD}$. Accordingly, a resistance $R_{32}$ between node 32 and ground decreases as $V_{DD}$ increases and increases as $V_{DD}$ decreases. An increase in $V_{DD}$ will tend to increase a voltage $V_{32}$ at node 32, whereas a decrease in resistance $R_{32}$ will tend to decrease voltage $V_{32}$. Consequently because transistor 26 causes resistance $R_{32}$ to decrease when $V_{DD}$ increases, transistor 26 provides some compensation for increases in $V_{DD}$. A decrease in $V_{DD}$ will tend to decrease voltage $V_{32}$, whereas an increase in resistance $R_{32}$ will tend to increase voltage $V_{32}$. Consequently because transistor 26 causes resistance $R_{32}$ to increase when $V_{DD}$ decreases, transistor 26 provides some compensation for decreases in $V_{DD}$. Therefore, some compensation is provided for both increases and decreases in $V_{DD}$.

Equations (1) through (6) are applicable to reference voltage generator 12 as well as reference voltage generator 10 with voltage $V_{R2}$ analogous to voltage $V_{R1}$, a resistance $R_{24}$ of resistor 24 analogous to resistance $R_{12}$, a threshold voltage $V_{T28}$ of transistor 28 analogous to threshold voltage $V_{T16}$, a body effect voltage $V_{B2}$ of transistor 30 analogous to body effect voltage $V_{B1}$, a resistance $R_{26}$ associated with transistor 26 analogous to resistance $R_{14}$, a voltage $V_{32}$ at node 32 analogous to voltage $V_{20}$, and a threshold voltage $V_{T30}$ of transistor 30 analogous to threshold voltage $V_{T18}$. Substituting analogous elements of reference voltage generator 22 into equation 6 results in the following equation:

$$V_{R2}=\frac{R_{26}V_{DD}}{R_{24}+R_{26}}-\frac{R_{26}V_{T28}}{R_{24}+R_{26}}-V_{B2} \quad (7)$$

Body effect voltage $V_{B2}$ and threshold voltage $V_{T28}$ are essentially fixed constants. Resistance $R_{24}$ is a chosen constant. Resistance $R_{26}$ is a function of chosen features of transistor 26 and is inversely proportional to $V_{DD}$. $V_{DD}$ is a variable for which compensation is desired. The choices of resistance $R_{26}$ and features of transistor 26 are made, however, by assuming $V_{DD}$ is a constant at its nominal voltage, for example 5 volts.

A general equation for current through transistor 26 is as follows:

$$I_D=K(W/L)[2(V_{GS}-V_T)V_{DS}-V_{DS}^2] \quad (8)$$

$I_D$ is the current through transistor 26, K is a device constant, for example $2.16\times10^{-5}$, W is the channel width of transistor 26, L is the channel length of transistor 26, $V_{GS}$ is the gate to source voltage on transistor 26, $V_T$ is the threshold voltage of transistor 26, and $V_{DS}$ is the drain to source voltage on transistor 26. The current through transistor 26 is known for the assumed voltage of $V_{DD}$. A current $I_{24}$ is a design choice, for example 10 microamps, which determines resistance $R_{24}$ in conjunction with a design choice of reference voltage $V_{R2}$. Current $I_{24}$ is expressed as:

$$I_{24}=\frac{V_{DD}-V_{32}}{R_{24}} \quad (9)$$

Voltage $V_{32}$ is a function of reference voltage $V_{R2}$ as follows:

$$V_{32}=V_{R2}-V_{T30}-V_{B2} \quad (10)$$

Therefore current $I_{24}$ is a function of reference voltage $V_{R2}$ as follows:

$$I_{24} = \frac{V_{DD} - V_{R2} + V_{T30} + V_{B2}}{R_{24}} \quad (11)$$

From this equation, resistance $R_{24}$ can be easily selected for the desired current $I_{24}$, assumed voltage of $V_{DD}$, and chosen reference voltage $V_{R2}$ with threshold voltage $V_{T30}$ and body effect voltage $V_{B2}$ being constant. Threshold voltage $V_{T30}$ does vary over process slightly, but transistor 28 provides substantial compensation for this variation.

In order to solve for the size ratio W/L of transistor 26 to obtain the desired reference voltage $V_{R2}$, equation (8) is used to express size ratio W/L in terms of reference voltage $V_{R2}$ and other circuit parameters. Gate to source voltage $V_{GS}$ is expressed as follows:

$$V_{GS} = V_{DD} - V_{T28} \quad (12)$$

Drain to source voltage $V_{DS}$ is expressed as follows:

$$V_{DS} = V_{32} - V_{T28} \quad (13)$$

Substituting the expression for voltage $V_{32}$ of equation (10) results in the following equation:

$$V_{DS} = V_{R2} - V_{T30} - V_{B2} - V_{T28} \quad (14)$$

Now substituting into equation (8) relative to transistor 26 results in the following equation:

$$I_{24} = K(W/L)[2(V_{DD} - V_{T28} - V_{T26})(V_{R2} - V_{T30} - V_{B2} - V_{T28}) - (V_{R2} - V_{T30} - V_{B2} - V_{T28})^2] \quad (15)$$

Solving for size ratio W/L results in the following equation:

$$\frac{W}{L} = \frac{I_{24}}{K[2(V_{DD} - V_{T28} - V_{T26})(V_{R2} - V_{T30} - V_{B2} - V_{T28}) - (V_{R2} - V_{T30} - V_{B2} - V_{T28})^2]} \quad (16)$$

Accordingly, the size ratio W/L can be solved by substituting for the chosen value of current $I_{24}$, constant K, assumed value $V_{DD}$, threshold voltage $V_{T28}$, threshold voltage $V_{T26}$, chosen reference voltage $V_{R2}$, threshold voltage $V_{T30}$, and body effect voltage $V_{B2}$. This size ratio will then cause reference voltage generator 22 to provide the chosen reference voltage $V_{R2}$ at the assumed value of $V_{DD}$. Transistor 26 then provides improved compensation with variations in $V_{DD}$. It should be noted that if transistor 26 has a very small size ratio, it may have a slightly higher threshold voltage, for example 0.2 volts higher, than that of transistors 28 and 30.

Figure 3:
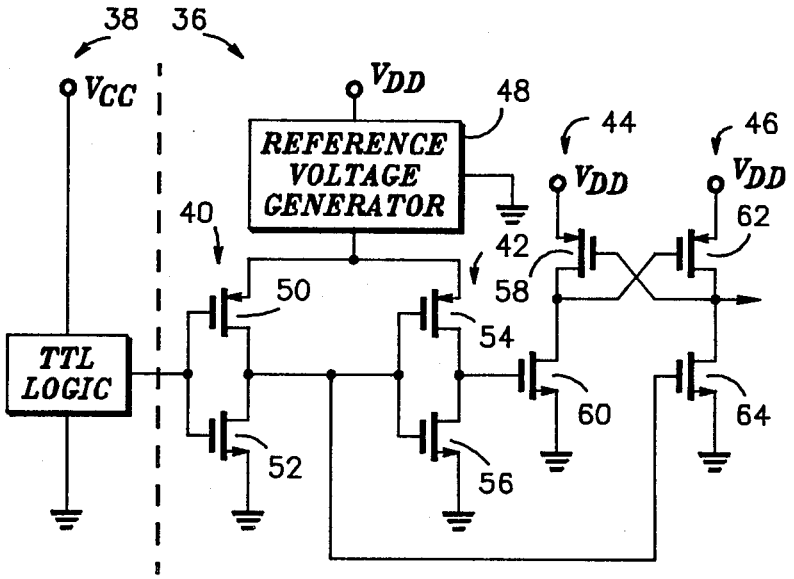
FIG. 3 is a circuit diagram of a TTL to CMOS input buffer according to a preferred embodiment of the present invention.

Shown in FIG. 3 is a TTL to CMOS input buffer 36 for providing an output in response to receiving a TTL signal from a TTL logic circuit 38 which is coupled between a TTL positive power supply voltage, shown as $V_{CC}$, and ground. Input buffer 36 comprises generally an inverter 40, an inverter 42, an amplifier 44, an amplifier 46 and a reference voltage generator 48.

Reference voltage generator 48 is connected to a positive power supply terminal $V_{DD}$, the voltage at which can be, for example, 5 volts, and to a negative power supply terminal, shown as ground. Reference voltage generator 48 provides a reference voltage $V_{48}$ at an output.

Inverter 40 comprises a P channel transistor 50 and an N channel transistor 52. Transistor 50 has a gate as an input of inverter 40 for receiving the TTL signal from TTL logic circuit 38, a drain for providing an output of inverter 40, and a source connected to the output of reference voltage generator 48. Transistor 52 has a gate connected to the gate of transistor 50, a drain connected to the drain of transistor 50, and a source connected to ground.

Inverter 42 comprises a P channel transistor 54 and an N channel transistor 56. Transistor 54 has a gate as an input of inverter 42 connected to the drain of transistor 50, a drain for providing an output of inverter 42, and a source connected to the output of reference voltage generator 48. Transistor 56 has a gate connected to the gate of transistor 54, a drain connected to the drain of transistor 54, and a source connected to ground.

Amplifier 44 comprises a P channel transistor 58 and an N channel transistor 60. Transistor 60 has a gate coupled to the drain of transistor 54, a source coupled to ground, and a drain for providing an output of amplifier 44. Transistor 58 has a source connected to $V_{DD}$, a drain connected to the drain of transistor 60, and a gate for receiving an output of amplifier 46.

Amplifier 46 comprises a P channel transistor 62 and an N channel transistor 64. Transistor 62 has a gate connected to the drain of transistor 60, a drain for providing the output of amplifier 46 and the output of input buffer 36 connected to the gate of transistor 58, and a source connected to $V_{DD}$. Transistor 64 has a gate connected to the drain of transistor 50, a drain connected to the drain of transistor 62, and a source connected to ground.

Inverters 40 and 42 and cross-coupled amplifiers 44 and 46 are connected as a conventional CMOS level-shifter. A logic "1" on the input of inverter 40 causes transistor 52 to turn on so that the output of inverter 40 is at essentially ground which turns off transistors 56 and 64 and turns on transistor 54. Transistor 54 then couples the voltage on its source to the gate of transistor 60, turning transistor 60 sufficiently on so that its drain is at essentially ground, which in turn causes transistor 62 to turn on. A logic "1" is consequently supplied by the output of input buffer 36 at essentially $V_{DD}$. Conversely when a logic "0" is received on the input of inverter 40, transistor 50 turns on to provide a voltage on the output of inverter 40 which is essentially the voltage on the source of transistor 50. The output of inverter 40 then turns on transistor 64 so that the drain of transistor 64, which is also the output of input buffer 36, is at essentially ground. In addition, with transistor 50 on, transistor 56 will turn on causing the output of inverter 42 to be at essentially ground which will turn transistor 60 off. With the drain of transistor 64 at essentially ground transistor 58 will be on to provide essentially $V_{DD}$ to the drain of transistor 60 and the gate of transistor 62, so that transistor 62 is off.

This operation of a CMOS level-shifter ensures that one of the transistors in each of inverter 42, amplifier 44 and amplifier 46 will be off in a static condition. Consequently these three circuits do not provide a current path in a static condition. In conventional operation, inverter 40, as well as inverter 42, would have the same power supply connections as that of a CMOS circuit which generates a CMOS signal needing level shifting. A logic "1" would be at essentially the positive power supply voltage and a logic "0" would be at the negative power supply voltage so that one of transistors 50 and 52 would always be off in a static condition. In conventional operation, inverters 40 and 42 operate as output buffers providing true and complementary outputs to cross-coupled amplifiers 44 and 46, a level-shift interface actually being defined between the inverters and the cross-coupled amplifiers.

Operation of input buffer 36, however, defines an interface between TTL logic circuit 38 and inverter 40. The TTL signal generated by TTL logic circuit 38 could be anywhere between 2.0 volts and $V_{CC}$, nominally 5 volts, and still be a logic "1". If the source of transistor 50 was coupled to $V_{CC}$ when a logic "1" of 2.0 volts was received, both transistors 50 and 52 would be on, providing a power wasting current path. Consequently, reference voltage $V_{48}$ of reference voltage generator 48 is coupled to the source of transistor 50. Reference voltage $V_{48}$ is chosen so that transistor 50 will be off even when the TTL signal is at the lowest voltage level for a logic "1", in this case 2.0 volts. In order to ensure that transistor 50 will be off, reference voltage $V_{48}$ must be less than the lowest voltage level for a logic "1" minus the highest threshold voltage $V_{T50}$ of transistor 50, in this case, 2.0 volts minus −0.4 volts which equals 2.4 volts. Consequently reference voltage $V_{48}$ should be less than 2.4 volts.

Reference voltage generator 22 of FIG. 2 could be used as reference voltage generator 48 to provide reference voltage 48 at less than 2.4 volts with reference voltage $V_{R2}$. Other, conventional reference voltage generators could also be used. The power saved by preventing inverter 40 from having a current path between positive and negative power supply terminals, however, may not be sufficient to offset the current used by other reference voltage generators.

The utility for reference voltage generator 48 is apparent in the case, as is the case with TTL, where there is a substantial difference between the positive power supply voltage $V_{CC}$ and the lowest voltage level for a logic "1", 2.0 volts. If the lowest voltage level for a logic "1" is within a threshold voltage $V_{T50}$ of $V_{CC}$, then transistor 50 could be ensured of being off when the TTL signal is logic "1" by simply having the source of transistor 50 connected to $V_{CC}$, or even $V_{DD}$ if $V_{DD}$ is at essentially the same voltage as $V_{CC}$. Consequently reference voltage generator 48 is needed when the lowest voltage level for a logic "1" minus threshold voltage $V_{T50}$ is less than $V_{CC}$. Reference voltage $V_{48}$ is then chosen to be no closer to $V_{CC}$ than the lowest voltage level for a logic "1" minus threshold voltage $V_{50}$.

In choosing reference voltage $V_{48}$ consideration must also be given to the TTL signal in a logic "0" condition, which for TTL is ground to 0.8 volts. Transistor 50 must be on when the TTL signal is at 0.8 volts. Accordingly, the voltage at the source of transistor 50, $V_{48}$, must be greater than 0.8 volts minus the smallest threshold voltage $V_{T50}$, i.e., 0.8 minus −0.8 which equals 1.6 volts. Consequently reference voltage $V_{48}$ should be between 1.6 and 2.4 volts. For reasons concerning speed, the voltage should be made closest to the higher of the two voltages.

While the invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

I claim:

1. A reference voltage generator comprising:

a resistor having a first terminal coupled to a first power supply terminal and a second terminal;

a first insulated gate field effect transistor having a first current electrode coupled to the second terminal of the resistor, a control electrode directly connected to the first power supply terminal, and a second current electrode;

a second insulated gate field effect transistor having a first current electrode and a control electrode coupled to the second current electrode of the first insulated gate field effect transistor, and a second current electrode coupled to a second power supply terminal; and a third insulated gate field effect transistor having a first current electrode directly connected to the first power supply terminal, a control electrode directly connected to the second terminal of the resistor; and a second current electrode for providing a reference voltage;

wherein the first, second, and third insulated gate field effect transistors are of the same conductivity type.

* * * * *